US009222688B2

(12) United States Patent
Ishizaka

(10) Patent No.: US 9,222,688 B2
(45) Date of Patent: Dec. 29, 2015

(54) AIR CONDITIONING CONTROL DEVICE, AIR CONDITIONING CONTROL METHOD AND PROGRAM

(75) Inventor: Taichi Ishizaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 399 days.

(21) Appl. No.: 13/811,932

(22) PCT Filed: Jan. 27, 2011

(86) PCT No.: PCT/JP2011/051653

§ 371 (c)(1),
(2), (4) Date: Jan. 24, 2013

(87) PCT Pub. No.: WO2012/023297

PCT Pub. Date: Feb. 23, 2012

(65) Prior Publication Data

US 2013/0123992 A1 May 16, 2013

(30) Foreign Application Priority Data

Aug. 18, 2010 (JP) ..... 2010-182919

(51) Int. Cl.
*G01M 1/38* (2006.01)
*F24F 5/00* (2006.01)
(Continued)

(52) U.S. Cl.
CPC . *F24F 5/00* (2013.01); *F24F 3/065* (2013.01); *F24F 11/006* (2013.01);
(Continued)

(58) Field of Classification Search
CPC ..... F24F 2011/0067; F24F 2011/0071; G06F 1/206; G06F 9/5094; G06F 1/3203; G06F 12/02; G05B 2219/2614
USPC ..... 700/2, 17, 100, 108, 276, 277, 278
See application file for complete search history.

(56) References Cited

U.S. PATENT DOCUMENTS 6,199,390 B1 * 3/2001 Mukohara et al. ..... 62/127
7,378,980 B2 * 5/2008 McFarland ..... 340/686.6
(Continued)

FOREIGN PATENT DOCUMENTS

JP 11-287496 A 10/1999
JP H11-287496 A 10/1999
(Continued)

OTHER PUBLICATIONS

Office Action dated Oct. 29, 2013 in the corresponding JP application No. 2012-529498 (English translation).
(Continued)

*Primary Examiner* — Darrin Dunn
(74) *Attorney, Agent, or Firm* — Posz Law Group, PLC

(57) ABSTRACT

An air-conditioning control device controls a plurality of air-conditioners (indoor devices) disposed at different locations within a predetermined living room space. A data manager stores location information for each air-conditioner (indoor device). A distance calculator calculates a distance between respective air-conditioners (indoor devices) based on the location information. A control order setter sets, based on the distance between respective air-conditioners (indoor devices) calculated by the distance calculator, a control order of each air-conditioner (indoor device) on which energy-saving control is to be performed in such a way that time spans for performing the energy-saving control that controls respective air-conditioners (indoor devices) for a predetermined time to suppress power consumption in respective sections of the living room space are balanced. The control executer repeatedly executes the energy-saving control on each air-conditioner (indoor device) in accordance with the control order set by the control order setter.

16 Claims, 17 Drawing Sheets

(51) Int. Cl.
*F24F 3/06* (2006.01)
*F24F 11/00* (2006.01)

(52) U.S. Cl.
CPC .... *F24F 11/0086* (2013.01); *F24F 2011/0063* (2013.01); *F24F 2011/0064* (2013.01); *F24F 2011/0075* (2013.01)

(56) References Cited

U.S. PATENT DOCUMENTS

| | | | | |
|---|---|---|---|---|
| 7,702,421 | B2 * | 4/2010 | Sullivan et al. | 700/276 |
| 7,809,472 | B1 * | 10/2010 | Silva et al. | 700/277 |
| 7,963,454 | B2 * | 6/2011 | Sullivan et al. | 236/51 |
| 8,239,068 | B1 * | 8/2012 | Rossi et al. | 700/277 |
| 8,290,628 | B2 * | 10/2012 | Yeo | 700/277 |
| 8,295,981 | B2 * | 10/2012 | Hadzidedic | 700/276 |
| 8,838,763 | B2 * | 9/2014 | Grohman | 709/223 |
| 2004/0117069 | A1 * | 6/2004 | Yoon et al. | 700/276 |
| 2007/0084937 | A1 * | 4/2007 | Ahmed | 236/44 C |
| 2008/0178615 | A1 * | 7/2008 | Yoon et al. | 62/79 |
| 2009/0066473 | A1 * | 3/2009 | Simons | 340/3.1 |
| 2009/0307255 | A1 * | 12/2009 | Park | 707/102 |
| 2010/0036533 | A1 * | 2/2010 | Masuda et al. | 700/278 |
| 2010/0145485 | A1 * | 6/2010 | Duchene et al. | 700/90 |
| 2010/0298986 | A1 * | 11/2010 | Stachler | 700/276 |
| 2012/0158932 | A1 * | 6/2012 | Grohman | 709/223 |
| 2012/0283881 | A1 * | 11/2012 | Federspiel | 700/276 |

FOREIGN PATENT DOCUMENTS

| | | | |
|---|---|---|---|
| JP | 2002-010532 | A | 1/2002 |
| JP | 2006-029693 | A | 2/2006 |
| JP | 2006-038334 | A | 2/2006 |
| JP | 4331554 | B2 | 9/2009 |
| JP | 2010-020651 | A | 1/2010 |

OTHER PUBLICATIONS

International Search Report of the International Searching Authority mailed Apr. 26, 2011 for the corresponding international application No. PCT/JP2011/051653 (with English translation).
Extended European Search Report dated Feb. 18, 2014 issued in the corresponding EP application No. 11817946.4.

* cited by examiner

FIG.7

PERFORM ENERGY-SAVING CONTROL ON AIR-CONDITIONER 01

PERFORM ENERGY-SAVING CONTROL ON AIR-CONDITIONER 04

| AIR-CONDITIONER NUMBER | DISTANCE FROM PREVIOUS CONTROL-TARGET AIR-CONDITIONER (01) | DISTANCE FROM TIME BEFORE LAST CONTROL-TARGET AIR-CONDITIONER | PROXIMITY ORDER |
|---|---|---|---|
| 02 | 20.0 | — | 1 |
| 03 | 20.0 | — | 2 |
| 04 | 28.3 | — | 3 |
| 05 | 40.0 | — | 4 |
| 06 | 44.7 | — | 5 |

PERFORM ENERGY-SAVING CONTROL ON AIR-CONDITIONER 06

| AIR-CONDITIONER NUMBER | DISTANCE FROM PREVIOUS CONTROL-TARGET AIR-CONDITIONER (04) | DISTANCE FROM TIME BEFORE LAST CONTROL-TARGET AIR-CONDITIONER (01) | PROXIMITY ORDER |
|---|---|---|---|
| 02 | 20.0 | 20.0 | 1 |
| 03 | 20.0 | 20.0 | 2 |
| 05 | 28.3 | 40.0 | 4 |
| 06 | 20.0 | 44.7 | 3 |

PERFORM ENERGY-SAVING CONTROL ON AIR-CONDITIONER 03

| AIR-CONDITIONER NUMBER | DISTANCE FROM PREVIOUS CONTROL-TARGET AIR-CONDITIONER (06) | DISTANCE FROM TIME BEFORE LAST CONTROL-TARGET AIR-CONDITIONER (04) | PROXIMITY ORDER |
|---|---|---|---|
| 02 | 40.0 | 20.0 | 3 |
| 03 | 28.3 | 20.0 | 2 |
| 05 | 20.0 | 28.3 | 1 |

PERFORM ENERGY-SAVING CONTROL ON AIR-CONDITIONER 02

| AIR-CONDITIONER NUMBER | DISTANCE FROM PREVIOUS CONTROL-TARGET AIR-CONDITIONER (03) | DISTANCE FROM TIME BEFORE LAST CONTROL-TARGET AIR-CONDITIONER (06) | PROXIMITY ORDER |
|---|---|---|---|
| 02 | 28.3 | 40.0 | 3 |
| 05 | 20.0 | 20.0 | 2 |

PERFORM ENERGY-SAVING CONTROL ON AIR-CONDITIONER 05

$$\text{DISTANCE} = \sqrt{((\text{DIFFERENCE VALUE IN x COORDINATES})^2 + (\text{DIFFERENCE VALUR IN y COORDINATES})^2)}$$

FIG.12B

| GROUP NUMBER | AIR-CONDITIONER NUMBER |
|---|---|
| 01 | 01, 02 |
| 02 | 03, 04 |
| 03 | 05, 06, 07 |
| 04 | 08, 09 |
| 05 | 10, 11 |

AIR CONDITIONING CONTROL DEVICE, AIR CONDITIONING CONTROL METHOD AND PROGRAM

CROSS REFERENCE TO RELATED APPLICATIONS

This application is a U.S. national stage application of PCT/JP2011/051653 filed on Jan. 27, 2011, and claims priority to, and incorporates by reference, Japanese Patent Application No. 2010-182919 filed on Aug. 18, 2010.

TECHNICAL FIELD

The present invention relates to an air-conditioning control device, an air-conditioning control method, and a program that control a plurality of air-conditioners disposed at different locations in a living room space of a building like a residential building.

BACKGROUND ART

In a living room space where a plurality of air-conditioners are disposed, when an energy-saving control (e.g., a deactivation control for a certain time period) that suppresses power consumption on all of the air-conditioners is performed simultaneously, a temperature in the living room space may sharply rise, resulting in a poor environmental comfort.

Hence, a method or a system is disclosed which performs an energy-saving control for a predetermined time on each of the plurality of air-conditioners while shifting the time span of such a control with each other, thereby suppressing a sharp temperature rise (when being cooled) and a sharp temperature drop (when being heated) (see, for example, Patent Literatures 1 and 2). Accordingly, energy savings is accomplished, while at the same time, a certain environmental comfort is maintained.

PRIOR ART LITERATURE

Patent Literature

Patent Literature 1: Japan Patent No. 4331554 (see FIG. 5)

Patent Literature 2: Unexamined Japanese Patent Application Kokai Publication No. 2006-29693 (see FIG. 4)

DISCLOSURE OF THE INVENTION

Problem to be Solved by the Invention

According to the operation control method, etc., disclosed in above Patent Literature 1, the living room space is divided into a plurality of zones, and a deactivation control on each air-conditioner is performed for each zone, while the time span of such a control is shifted for each zone. The deactivation control is performed in the arranged order of the zones. When the deactivation control for all zones completes, the process returns to the first zone, and the deactivation control is again performed in the arranged order of the zones. As explained above, the deactivation control is repeatedly performed in the arranged order of the zones.

When the deactivation control for each zone is repeated in the above-explained order, a time span for an energy-saving control performed at each zone may become unbalanced. An example of such a case is that, around each zone, a deactivation control on the air-conditioners is performed intensively during the first half of a cycle, but no deactivation control on the air-conditioners is performed at all in the latter half of the cycle. In this case, a fluctuation in a temperature of the living room space becomes great within each zone, and an environmental comfort of an occupant may be lost.

According to the demand control system disclosed in Patent Literature 2, an intermittent/rotation operation is performed on a system of a plurality of air-conditioners in accordance with a predetermined preference order. According to Patent Literature 2, however, how to specify such a preference order is not disclosed. Hence, even if this system is applied, it is unable to suppress the above-explained large fluctuation in a temperature.

The present invention has been made in view of such circumstances, and it is an objective of the present invention to provide an air-conditioning control device, an air-conditioning control method, and a program that can reduce environmental discomfort when an energy-saving control is performed.

Means for Solving the Problem

In order to accomplish the objective above, the air-conditioning control device of the present invention controls a plurality of air conditioners that are installed at different positions in a specified inhabited space, and includes the following features. A memory stores location information for each air-conditioner. A distance calculator calculates a distance between respective air-conditioners based on the location information stored in the memory. A control order setter sets, based on the distance between respective air-conditioners calculated by the distance calculator, a control order for each air conditioner on which energy-saving control is to be performed in such a way that time spans for performing the energy-saving control that controls respective air-conditioners for a predetermined time to reduce power consumption in respective sections of the living room space are balanced. A control executer repeatedly executed the energy-saving control on each air conditioner in accordance with the control order set by the control order setter.

Effects of the Invention

According to the present invention, a control order of each air-conditioner on which an energy-saving control is performed is set in such a way that a time span at which the energy-saving control is performed for controlling each air-conditioner for a predetermined time so as to suppress a power consumption in a section of a living room space is not unbalanced. Hence, fluctuation in temperature can be reduced. Accordingly, to mitigation of reduced environmental comfort due to energy-saving is possible.

BRIEF DESCRIPTION OF DRAWINGS

FIG. 7 is a diagram illustrating a flow of an energy-saving control;

FIG. 12B is a diagram illustrating an example correspondence relationship between the air-conditioner and the group;

MODE FOR CARRYING OUT THE INVENTION

First Embodiment

First, an explanation will be given of a first embodiment of the present invention.

Figure 1:
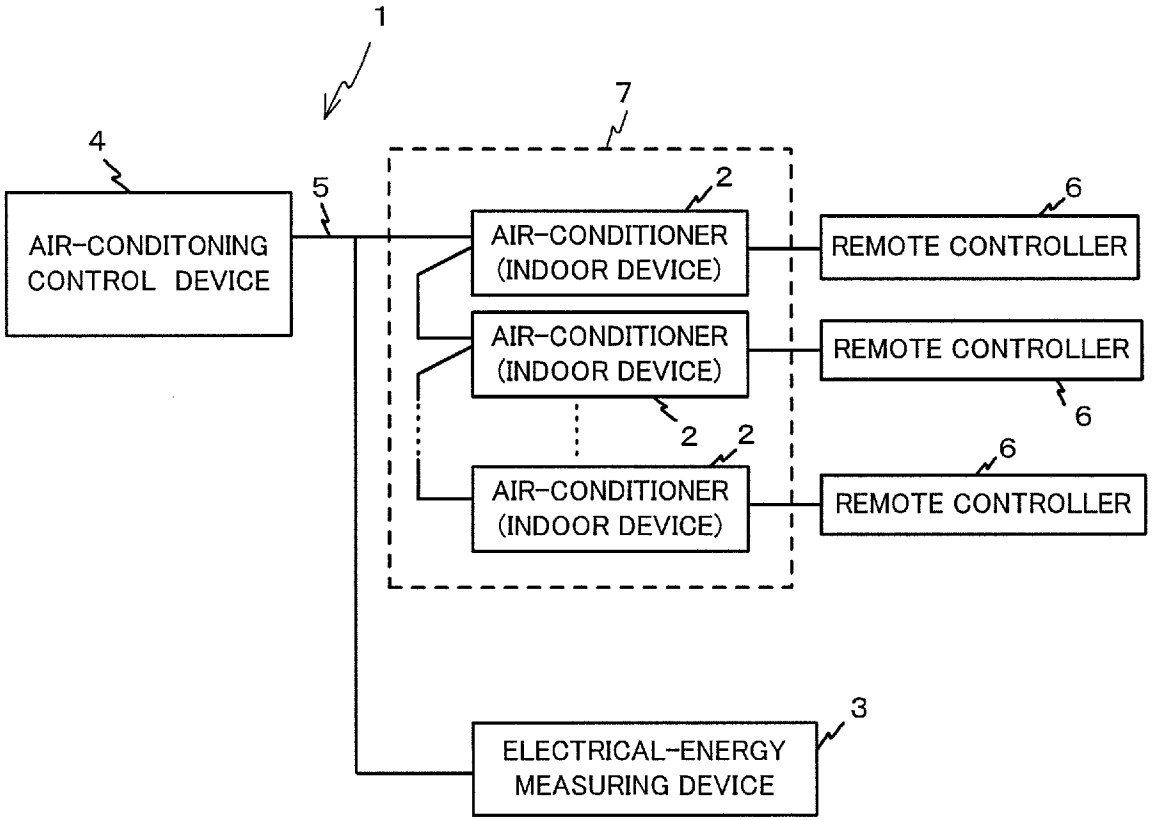
FIG. 1 is a block diagram illustrating a configuration of an air-conditioning system according to a first embodiment of the present invention.

FIG. 1 illustrates a configuration of an air-conditioning system 1 according to the first embodiment of the present invention. As illustrated in FIG. 1, the air-conditioning system 1 of this embodiment includes a plurality of air-conditioners (indoor devices) 2, an electrical-energy measuring device 3, and an air-conditioning control device 4.

The air-conditioners (indoor devices) 2, the electrical-energy measuring device 3, and the air-conditioning control device 4 are connected together via a dedicated communication line 5 so as to be able to communicate with each other. Moreover, although not particularly illustrated in FIG. 1, the air-conditioning control device 4 is connected with not only the air-conditioners (indoor devices) 2 but also with a heat-source-side unit (an outdoor device) having a compressor, etc., via the dedicated communication line 5 so as to be able to communicate with each other. Furthermore, each air-conditioner (indoor device) 2 is connected with a remote controller (a remote) 6.

The plurality of air-conditioners (indoor devices) 2 are disposed at respective different locations within a predetermined living room space. Each air-conditioner (indoor device) 2 performs air conditioning in the living room space under the control of the air-conditioning control device 4 in such a way that the temperature of the living room space becomes close to a set target temperature. More specifically, each air-conditioner (indoor device) 2 receives, from the air-conditioning control device 4, various instructions, such as a deactivation instruction, a blowing instruction, and a change instruction for the target temperature, utilized for an energy-saving control, and performs air conditioning in the living room space (surroundings of the disposed location) in accordance with the received instruction. Hereinafter, the plurality of air-conditioners (indoor devices) 2 are also referred to as an air-conditioner group 7.

The remote controller 6 is an operating terminal that allows a user to operate the air-conditioner (indoor device) 2. An operation/deactivation of the corresponding air-conditioner (indoor device) 2, a change in an operation mode like cooling/heating, a change in a target temperature, and a change in a wind direction and wind speed, etc., are enabled upon operating the remote controller 6.

The electrical-energy measuring device 3 is a device that measures an electrical energy of the air-conditioning system 1 or the whole building. The electrical energy measured by the electrical-energy measuring device 3 is used for changing a control content of the air-conditioner (indoor device) 2 to be discussed later.

Figure 2:
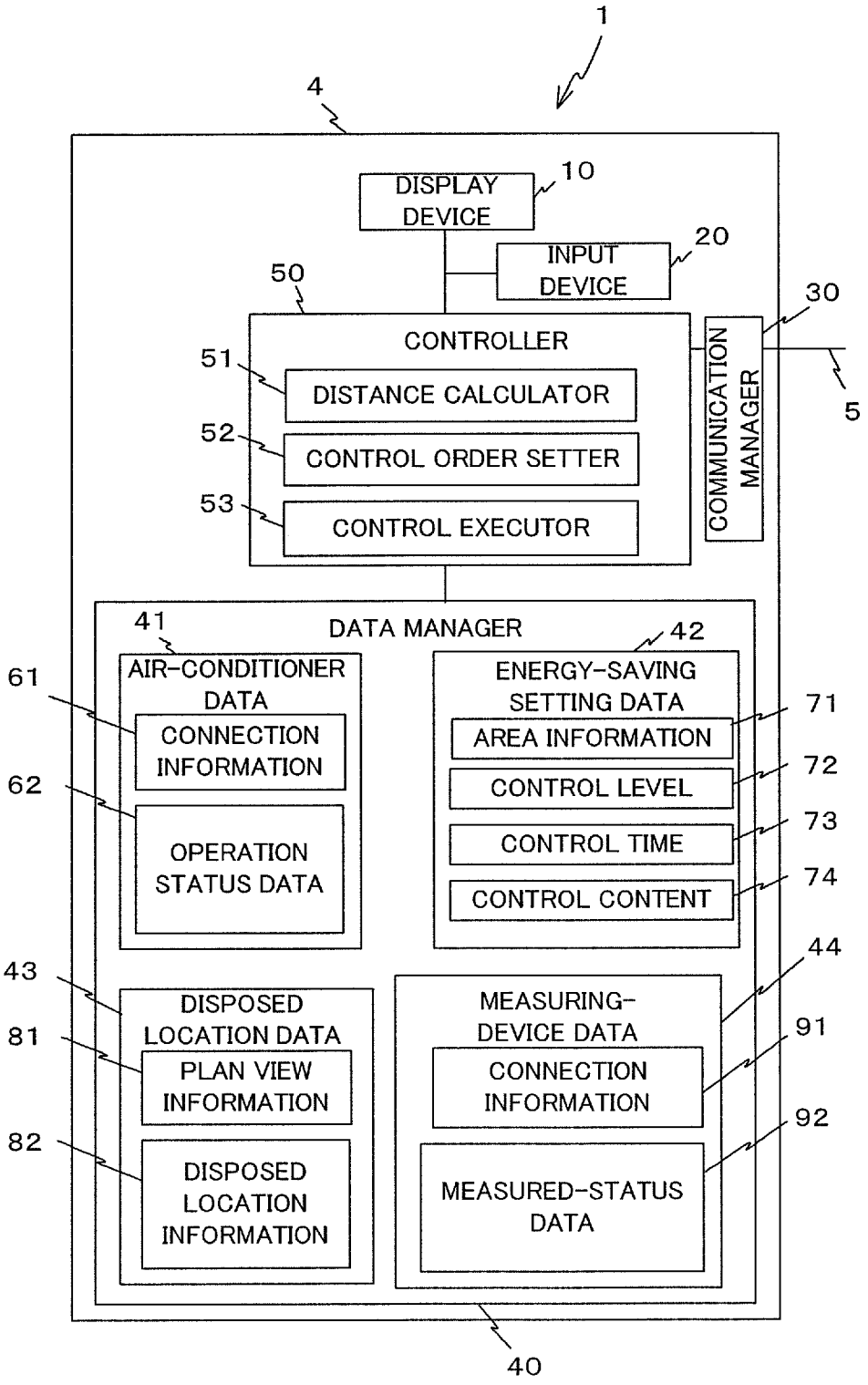
FIG. 2 is a block diagram illustrating a configuration of an air-conditioning control device in FIG. 1.

The air-conditioning control device 4 comprehensively controls and manages the air-conditioner group 7 including the plurality of air-conditioners (indoor devices) 2, and the electrical-energy measuring device 3. As illustrated in FIG. 2, the air-conditioning control device 4 includes a display device 10, an input device 20, a communication manager 30, a data manager 40, and a controller 50.

The display device 10 displays, for example, a monitoring screen for an operation status of each air conditioner (indoor device) 2, and an electrical energy measured by the electrical-energy measuring device 3 under the control of the controller 50.

The input device 20 includes a keyboard and a touch panel, etc. The touch panel is disposed on the display device 10. When a manager, etc., operates the keyboard and the touch panel, etc., a signal in accordance with the content of the operation (e.g., a change to the monitoring screen, an operation of the air-conditioner group 7, and various setting instructions) is output to the controller 50.

The communication manager 30 is the interface of the dedicated communication line 5. Data is transmitted/received between the air-conditioner (the indoor device) 2 and the electrical-energy measuring device 3 through the communication manager 30.

The data manager 40 manages various data necessary for the controller 50 to control the air-conditioner group 7. Data managed by the data manager 40 can be roughly divided into air-conditioner data 41, energy-saving setting data 42, disposed location data 43, and measuring-device data 44.

The air-conditioner data 41 includes connection information 61 regarding each air-conditioner (indoor device) 2, and operation status data 62 regarding each air-conditioner (indoor device) 2.

The connection information 61 is data necessary in order to access each air-conditioner (indoor device) 2 and is managed by the air-conditioner control device 4, such as an address number of each air-conditioner (indoor device) 2, an operation group number, and device-type identification information.

The operation status data 62 is data that indicates a current operation status of the air-conditioner (indoor device) 2, such as an operation/deactivation status of each air-conditioner (indoor device) 2, an operation mode like cooling/heating, a set temperature, or an indoor temperature. The operation status data 62 is updated as needed through a data transmission/reception with the air-conditioner (indoor device) 2.

The energy-saving setting data 42 includes area information 71, a control level 72, a control time 73, and control content 74.

The area information 71 is data associating each of the plurality of air-conditioners (indoor devices) 2 managed by the air-conditioning control device 4 with each of a plurality of areas being partitioned room by room or department by department, etc.

The control level 72 includes a threshold of electrical energy that changes a control level. When an electrical energy measurement obtained from the electrical-energy measuring device 3 exceeds the threshold, the air-conditioning control device 4 changes the control level of the air-conditioner (indoor device) 2.

The control time 73 is data that defines an execution time of the energy-saving control per a unit time with respect to each air-conditioner (indoor device) 2. The control time 73 can be specified for each area and each control level 72.

The control content 74 is data that defines a specific content for the energy-saving control like a deactivation control and a blowing control. The control content 74 can be specified for each area and each control level 72.

The disposed location data 43 includes plan view information 81, and disposed location information 82.

The plan view information 81is image data of a plan view of the floor of the living room space. In this embodiment, for example, the plan view information 81 which is created by a personal computer, etc., and which is read by the air-conditioning control device 4 is available. The plan view information 81 may be created by an operation input given by the user who has viewed the plan view displayed on the display device 10 to the input device 20.

The disposed location information 82 includes data relating to the building number of the living room space, the floor number thereof, and disposed positional coordinates (x coordinate, and y direction) of the air-conditioner (indoor device) 2.

The measuring-device data 44 manages connection information 91, and measured-status data 92. The connection information 91 includes address information of the electrical-energy measuring device 3 that measures electrical energy, and various kinds of setting data set for the electrical-energy measuring device 3, etc. The measured-status data 92 includes various kinds of measured data, such as an electrical energy, an instantaneous electric power, a voltage, and a current, obtained from the electrical-energy measuring device 3.

Data stored in the data manager 40 is written and read as needed by the controller 50.

The controller 50 includes a CPU and a memory (both unillustrated). The CPU executes a program stored in the memory, thereby realizing the functions of the controller 50.

The controller 50 controls the air-conditioner group 7 including the air-conditioners (indoor devices) 2. The controller 50 includes a distance calculator 51, a control order setter 52, and a control executor 53.

The distance calculator 51 calculates the distance between the air-conditioner (indoor device) 2 and another air-conditioner (indoor device) 2 based on the disposed location information stored in the data manager 40.

The control order setter 52 sets, based on the calculated distance between the air-conditioners (indoor devices) 2, the control order of respective air-conditioners (indoor devices) 2 that perform the energy-saving control in such a way that a time span for performing the energy-saving control on each air-conditioner (indoor device) 2 for a predetermined time in order to reduce power consumption in a section of the living room space will be balanced.

The control executor 53 repeatedly performs the energy-saving control on respective air-conditioners (indoor devices) 2 in accordance with the set order.

In addition, the controller 50 comprehensively controls respective elements of the air-conditioning control device 4.

Figure 3:
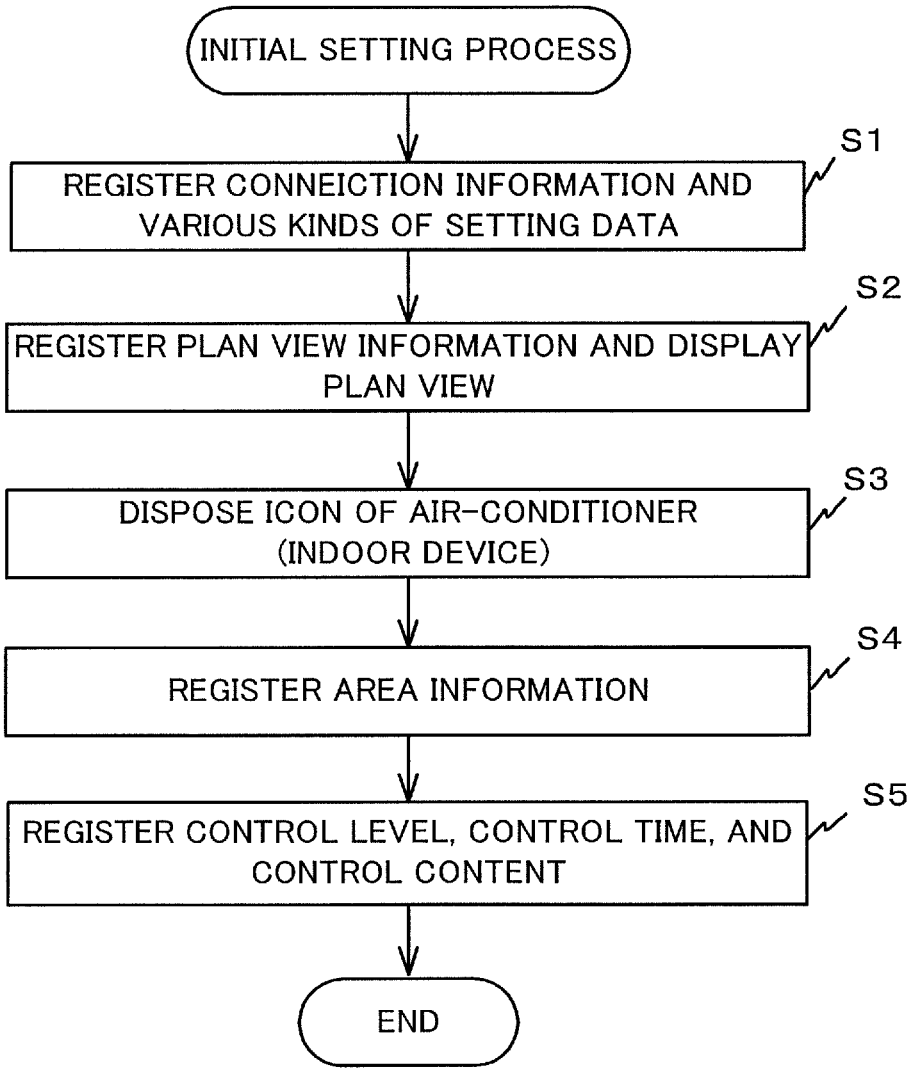
FIG. 3 is a flowchart of an initial setting process for the air-conditioning control device in FIG. 1.

Next, an explanation will be given of an operation of the air-conditioning control device 4. First, an initial setting process of various kinds of data by the data manager 40 of the air-conditioning control device 4 will be explained with reference to FIG. 3.

First, after the activation of the air-conditioning system 1, the controller 50 registers the connection information 61 of the air-conditioner (indoor device) 2 to be managed, the connection information 91 of the electrical-energy measuring device 3, and various kinds of setting data in the data manager 40 in accordance with an operation input using the input device 20 (step S1).

Next, the controller 50 reads plan view data of the floor of the living room space through, for example, the communication manager 30, registers the read data as the plan view information 81 in the data manager 40, and displays a plan view based on the plan view information 81 on the display device 10 (step S2).

Subsequently, the controller 50 disposes and displays an icon 400 of each air-conditioner (indoor device) 2 on the displayed plan view in accordance with an operation input using the input device 20 (step S3). The icon 400 is used for monitoring and operating the air-conditioner (indoor device) 2.

The position of the displayed icon 400 is adjustable in accordance with an operation input using the input device 20. At this time, it is fine if the user operates the input device 20 (a keyboard) and directly inputs positional coordinates to adjust respective positions of the icons 400 of respective air-conditioners (indoor devices) 2, or the user operates the input device 20 (a touch panel) to adjust respective positions of the icons 400 of respective air-conditioners (indoor devices) 2.

Figure 4:
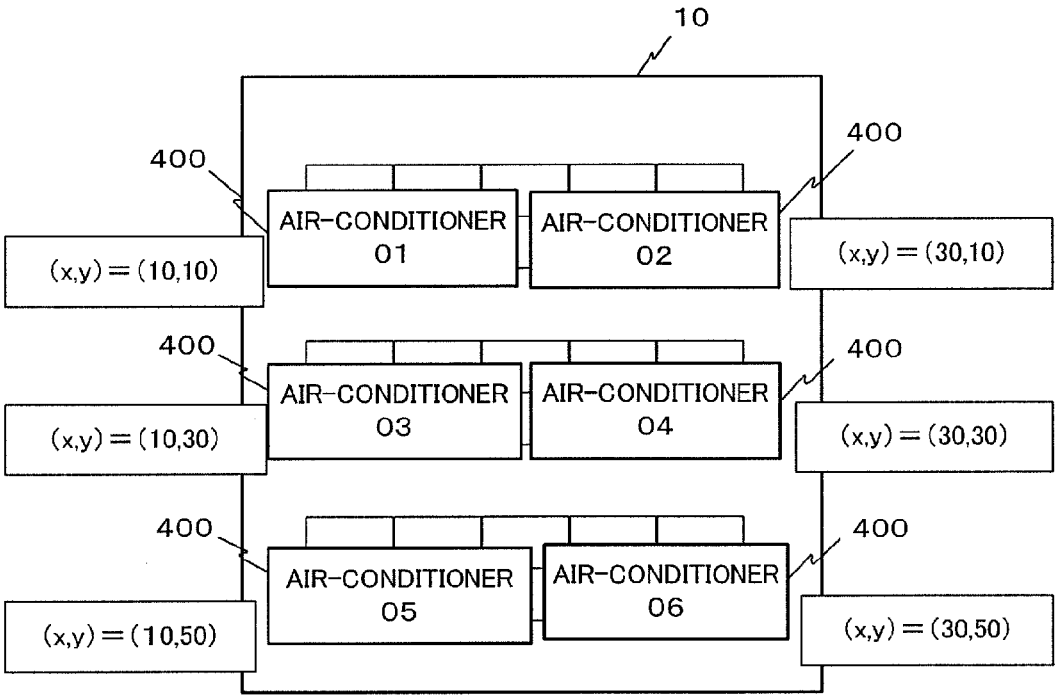
FIG. 4 is a diagram illustrating an example monitoring screen of an air-conditioner displayed on a display device.

FIG. 4 illustrates an example monitoring screen for the air-conditioners (indoor devices) 2 and is displayed on the display device 10. This monitoring screen displays the plan view of the floor of the living room space based on the plan view information 81. Moreover, this monitoring screen displays respective icons 400 of the air-conditioners (indoor devices) 2 on the plan view. In FIG. 4, respective icons 400 of the six air-conditioners (indoor devices) 01 to 06 are displayed.

The positional coordinates of the air-conditioners (indoor devices) 2 are displayed together with the icons 400. The positional coordinates of the icon 400 of the air-conditioner (indoor device) 2 as eventually set are registered in the data manager 40 as disposed location information 82.

The color and mark of the icon 400 indicate the operation status of the air-conditioner (indoor device) 2, such as: in operation, deactivation, or an abnormality. The controller 50 obtains the operation status of the air-conditioner (indoor device) 2 through the communication manager 30, registers the obtained operation status as the operation status data 62, and displays the color and mark of the icon 400 in accordance with the operation status.

When the icon 400 of each air-conditioner (indoor device) 2 is operated through the input device 20 (a touch panel), the controller 50 can control each air-conditioner (indoor device) 2 in accordance with such an operation.

Returning to FIG. 3, next the controller 50 registers as the area information 71, the area partitioned room by room or department by department through an operation input using the input device 20 (step S4). Each partitioned area is set in such a manner as to include at least one air-conditioner (indoor device) 2. Moreover, a plurality of air-conditioners (indoor devices) 2 may be included in a single area.

Figure 5:
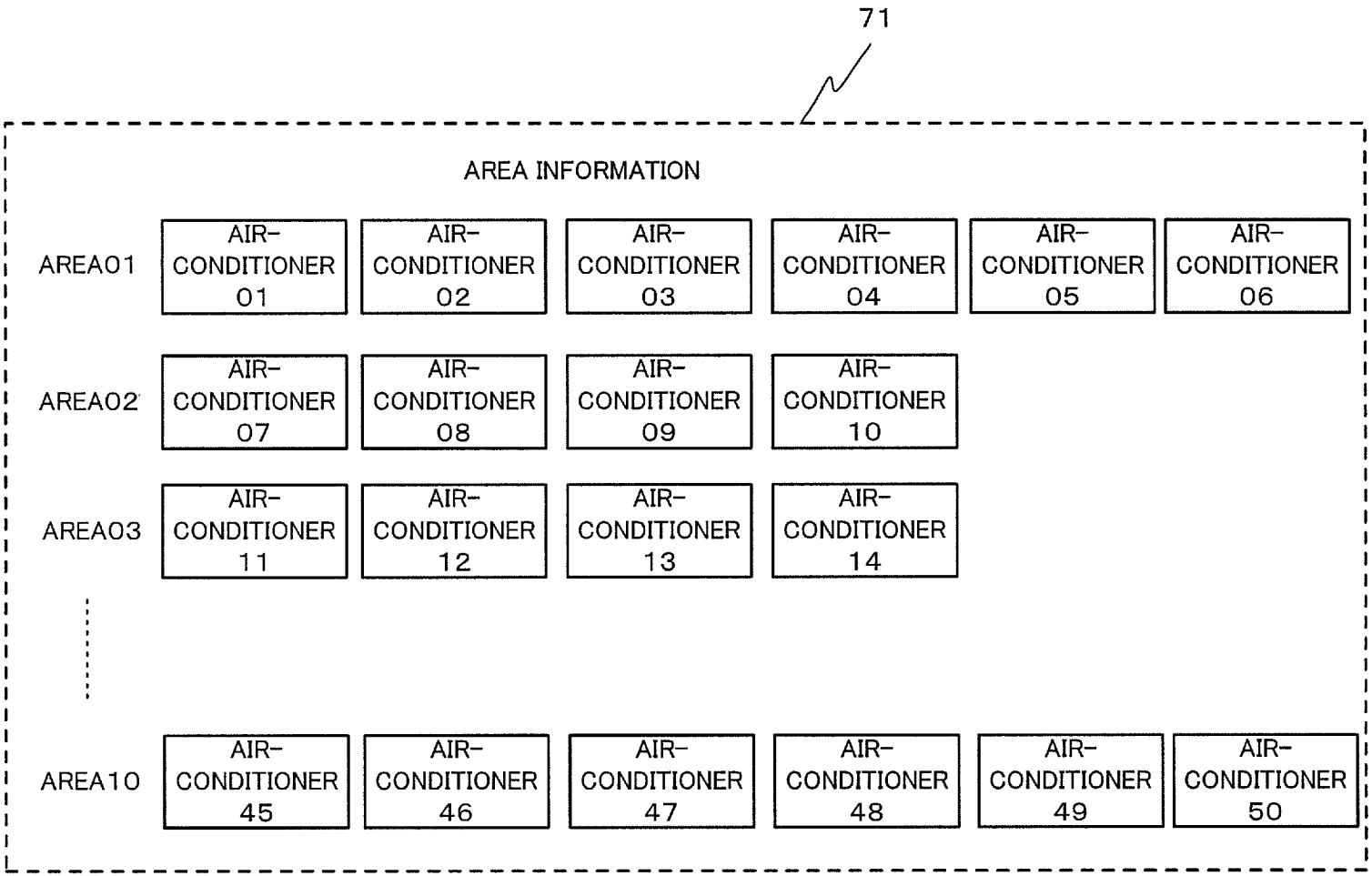
FIG. 5 is a diagram illustrating an example piece of area information.

FIG. 5 exemplarily illustrates example area information 71 having each of the plurality of air-conditioners (indoor device) 2 associated with the area. Respective areas are partitioned room by room or department by department. In the area information 71 illustrated in FIG. 5, air-conditioners 01 to 06 are associated with an area 01. Moreover, air-conditioners 07 to 10 are associated with an area 02. Furthermore, air-conditioners 11 to 14 are associated with an area 03. Still further, air-conditioners 45 to 50 are associated with an area 10. According to this embodiment, the energy-saving control is cyclically performed area by area.

Returning to FIG. 3, next, the controller 50 sets the control time 73 that is a time for performing the energy-saving control per a unit of time (e.g., controlling for three minutes for every 30 minute period) for each control level 72 in response to an operation input using the input device 20, and sets the control content 74 that is a control content (e.g., a deactivation control, a blowing control, or a thermo-off control) (step S5). Noted that each control level 72 changes in accordance with an electrical energy obtained from the electrical-energy measuring device 3. The user can register a threshold for changing the control level 72.

The initial setting process completes through the above-explained procedures.

Figure 6:
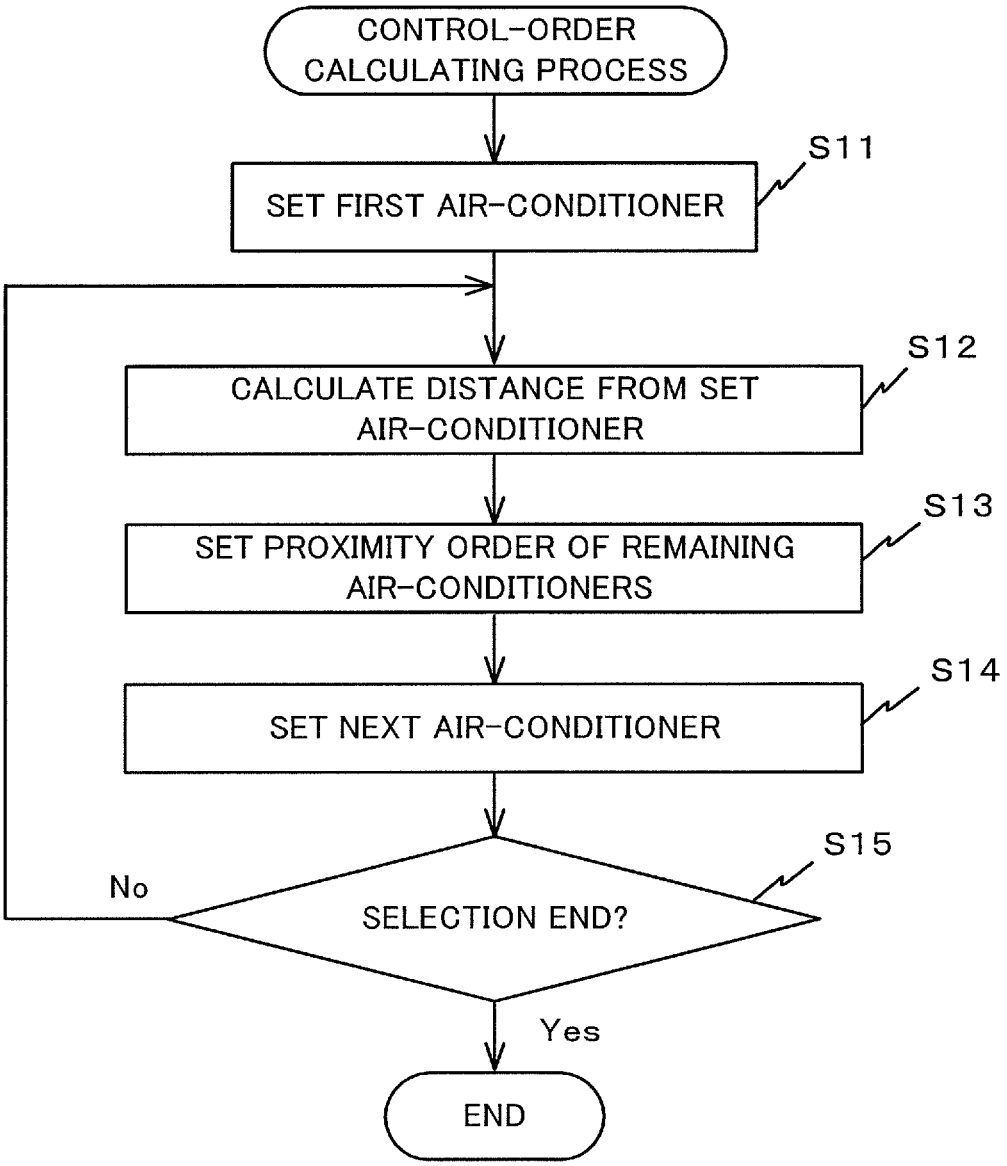
FIG. 6 is a flowchart of a control-order calculating process.

Next, an explanation will be given of a control-order calculating process for the energy-saving control with reference to FIG. 6. This process is performed when the air-conditioning control device 4 is activated, and when the connection information 61, area information 71, and disposed location information 82 of the air-conditioner (the indoor device) 2 are changed.

First, the control order setter 52 sets the air-conditioner (the indoor device) 2 on which the energy-saving control is first performed (step S11). The first air-conditioner (indoor device) 2 is arbitrary.

Next, the distance calculator 51 calculates the distance between the previous control-target air-conditioner and each remaining air-conditioner (the indoor device) 2, i.e., the distance from the set air-conditioner (indoor device) 2 is calculated (step S12). In this case, the distance from the previous control-target air-conditioner (indoor device) 2 can be obtained through the following formula.

$$\text{distance}=\sqrt{((\text{difference value in } x \text{ coordinates})^2+(\text{difference value in } y \text{ coordinates})^2)}$$

According to this embodiment, it is fine if a relative small and large relationship of the calculated distance between respective air-conditioners (indoor devices) 2 can be known, and thus (difference value in x coordinates)$^2$+(difference value in y coordinates)$^2$ can be directly calculated as such a distance unlike the above formula without applying a square root.

Next, the control order setter 52 sets a proximity order in the order of a closer distance between the remaining air-conditioners (indoor device) 2 on which no energy-saving control has yet been performed, and the previous control-target air-conditioner (in this case, the air-conditioner 01) is set (step S13). The proximity order assigns numbers, such as 1, 2, 3, . . . , in the order of closer distances.

When there are plural air-conditioners (indoor device) 2 that have equal distance from the previous control-target air-conditioner (indoor device) 2, the control order setter 52 can set the air-conditioner that has a shorter distance from the control-target air-conditioner of the time before last as an antecedence in the proximity order. Moreover, when there is no control-target air-conditioner of the time before last (when the distance of the second air-conditioner (indoor device) 2 is calculated), or when the distance from the control-target air-conditioner (indoor device) 2 of the time before last is the same, the control order setter 52 can set the air-conditioner (indoor device) 2 that has a smaller address as the antecedence in the proximity order.

Next, the control order setter 52 selects, as the next control-target, the air-conditioner (indoor device) 2 in the middle of the set proximity order, i.e., the air-conditioner (indoor device) 2 having the proximity order obtained through the following formula (step S14).

$$\text{Proximity order of next control-target air-conditioner}=((\text{number of remaining air-conditioners})/2)+1$$

When, however, (number of remaining air-conditioners)2 is indivisible, the decimal numbers are rounded off According to the above formula, when the number of the remaining air-conditioners (indoor devices) 2 on which no energy-saving control has yet been performed yet is an odd number, the air-conditioner (indoor device) 2 in the middle of the proximity order is selected, and when the number of the remaining air-conditioners (indoor devices) 2 is an even number, the air-conditioner (indoor device) 2 having a proximity order immediately prior to the middle proximity order is selected. For example, when the number of the remaining air-conditioners (indoor devices) is seven, the air-conditioner (indoor device) 2 having a fourth proximity order is selected, and when the number of the remaining air-conditioners (indoor devices) 2 is four, the air-conditioner (indoor device) 2 having a third proximity order is selected.

Next, the control order setter 52 determines whether or not all air-conditioners (indoor devices) 2 have already been selected (step S15). When any unselected air-conditioner (indoor device) still remains (step S15: No), the controller 50 returns the process to the step S12.

Thereafter, the steps S12, S13, S14, and S15 are repeated until all air-conditioners (indoor devices) 2 have been selected (step S15: Yes), and the control order of the air-conditioners (indoor devices) 2 on which the energy-saving control is to be performed has been set.

An explanation will be given of, with reference to FIG. 7, a case in which the six air-conditioners which are the air-conditioners (indoor devices) 01 to 06 disposed at respective positional coordinates illustrated in FIG. 4. As illustrated in FIG. 7, the air-conditioner 01 is set to be the air-conditioner (indoor device) 2 on which the energy-saving control is to be first performed within this area.

Through the execution of the above-explained control-order calculating process, as a second control-target air-conditioner (indoor device) 2, the [air-conditioner 04] having a third proximity order is selected among the five remaining air-conditioners 02, 03, 04, 05, and 06. Moreover, as a third control-target air-conditioner, the [air-conditioner 06] having the third proximity order is selected among the four remaining air-conditioners 02, 03, 05, and 06. Likewise, the [air-conditioner 03] is selected as a fourth control-target air-conditioner. Next, the [air-conditioner 02] is selected as a fifth control-target air-conditioner. Subsequently, the [air-conditioner 05] is selected as a sixth control-target air-conditioner. After the last [air-conditioner 05], the process returns to the [air-conditioner 01] to be controlled and the energy-saving control is repeatedly performed in this order.

Figure 8:
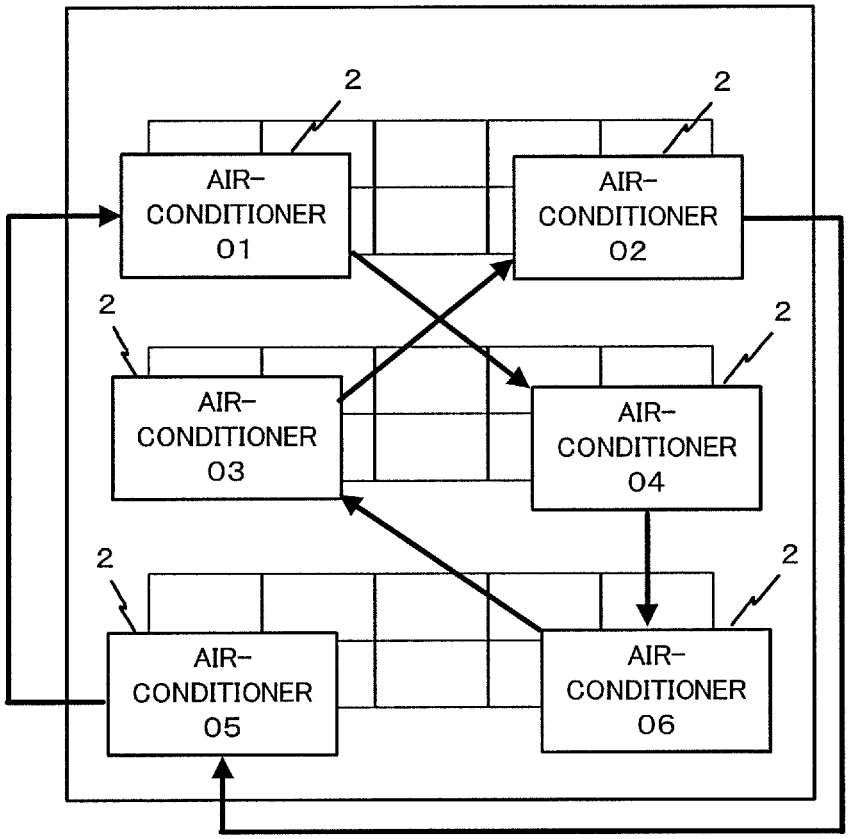
FIG. 8 is a diagram illustrating a (first) example control order of the energy-saving control.
Figure 9:
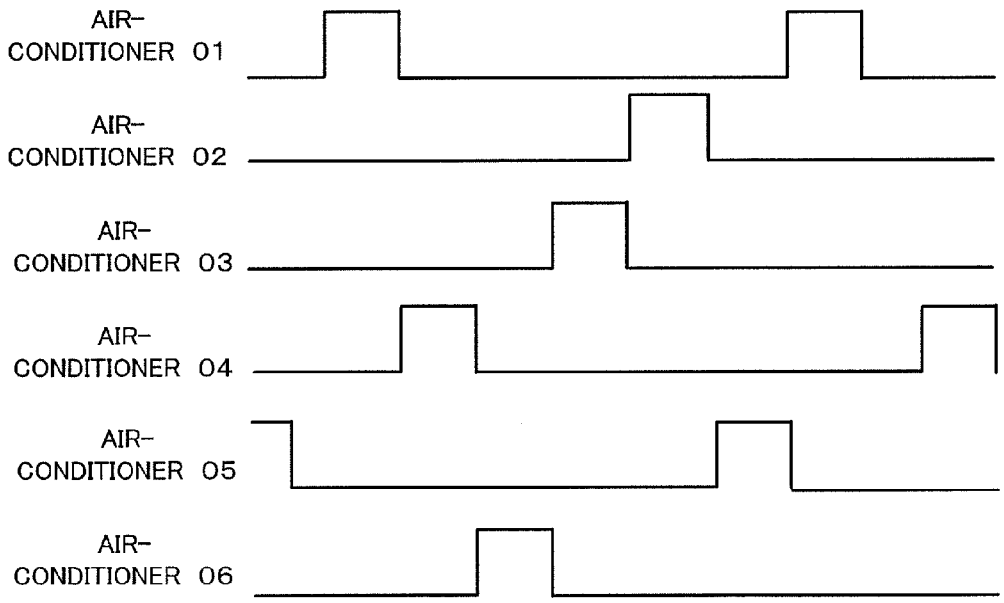
FIG. 9 is a timing chart of an on/off pattern of the energy-saving control.

FIG. 8 exemplarily illustrates the control order of the energy-saving control on the indoor devices 01 to 06 set in accordance with the control-order process obtained above. Moreover, FIG. 9 illustrates a timing chart for the on/off pattern of the energy-saving control on the indoor devices 01 to 06. When the energy-saving control is performed in accordance with the control order illustrated in FIG. 8, the time span for performing the energy-saving control in a section of the living room space is not unbalanced, and thus a local and large fluctuation in temperature by the energy-saving control can be reduced.

Figure 10:
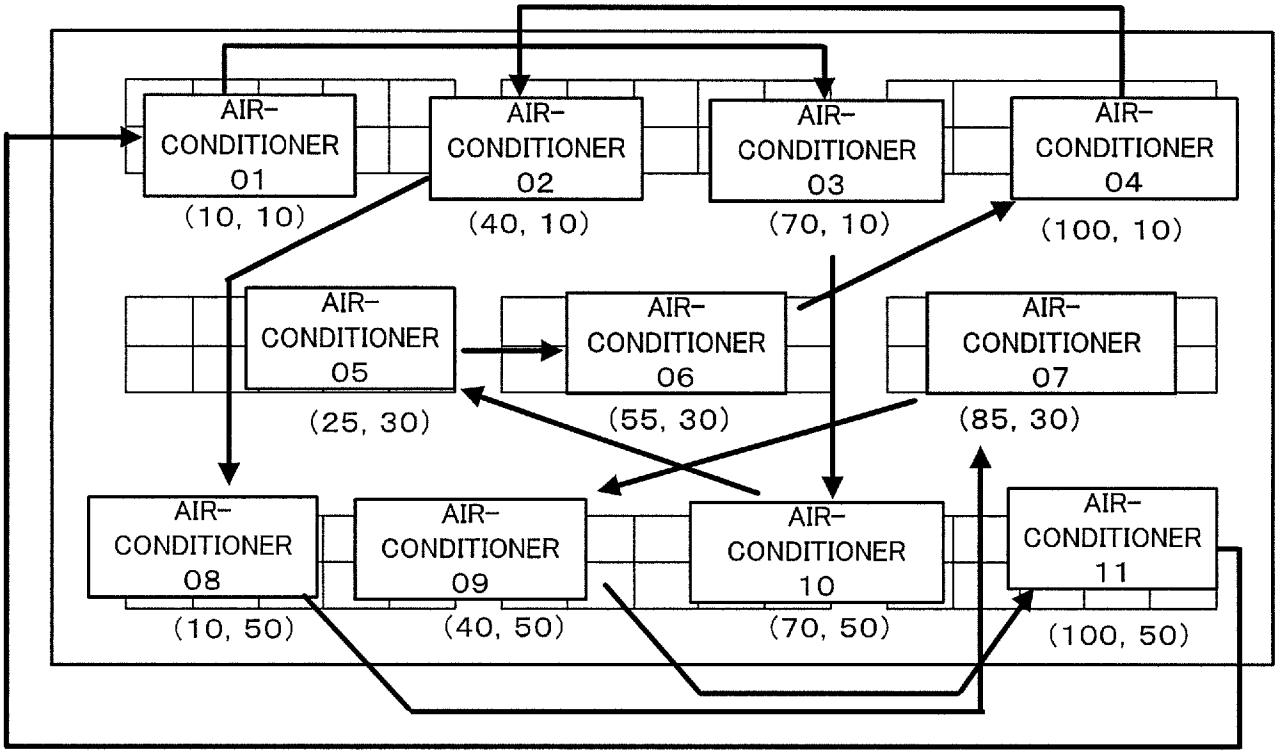
FIG. 10 is a diagram illustrating a (second) example control order of the energy-saving control.

FIG. 10 illustrates an example control order set when the number of the air-conditioners (indoor devices) 2 is eleven. As illustrated in FIG. 10, the control order for the energy-saving control is set in such a way that the places where the energy-saving control is performed are dispersed.

According to this embodiment, a calculation formula for selecting, as the next control-target air conditioner (indoor device) 2, the air-conditioner (indoor device) 2 having a substantially center proximity order in accordance with the distance from the control-target air-conditioner (indoor device) 2 is applied as the calculation formula for calculating the control order. The present invention is, however, not limited to this case, and the control order may be calculated through other calculation formulae as long as a calculation scheme in accordance with a distance between the air-conditioners (indoor devices) 2 is applied. For example, a calculation formula of selecting, as the next control-target air-conditioner, the air-conditioner (the indoor device) 2 having the proximity order of ⅓ or so of the whole may be applied.

The calculation formula may be changed in accordance with the connection information 61 and the disposed location information 82 in such a way that the calculation formula is changed in accordance with the number of the air-conditioners (indoor devices) 2.

According to this embodiment, the proximity order is set in consideration of up to the control-target air-conditioner (indoor device) 2 of the time before last, but the present invention is not limited to the air-conditioner of the time before last, and the proximity order may be set in consideration of a distance from the air-conditioner (indoor device) 2 which the energy-saving control is performed even prior to the air-conditioner of the time before last.

According to this embodiment, the location information of each air-conditioner (indoor device) 2 is obtained from the coordinate positions on a plan view. It is, however, fine if the actual positional coordinates of each air-conditioner (indoor device) 2 be measured in advance, the measured positional coordinates of each air-conditioner (indoor device) 2 be registered in the air-conditioning control device 4, and a distance between respective air-conditioners (indoor devices) 2 be calculated based on the registered positional coordinates at the time of a calculation of the control order.

The air-conditioner (indoor device) 2 itself may automatically measure a distance from another air-conditioner (indoor device) 2 through a technology like UWB (Ultra Wide Band), and the air-conditioning control device 4 may obtain the measured result from that air-conditioner (indoor device) 2 to calculate the control order for the energy-saving control.

As explained above in detail, according to the air-conditioning control device 4 of this embodiment, the control order for each air-conditioner (indoor device) 2 on which the energy-saving control is performed is set in such a way that the time span for performing the energy-saving control which controls each air-conditioner (indoor device) 2 for a predetermined time to reduce the power consumption in a section of the living room space is balanced. This mitigates a reduction in environmental comfort due to energy-savings.

According to this embodiment, moreover, it becomes possible to mitigate a rapid temperature change and to maintain the sensory temperature of an occupant to be as constant as possible. It becomes possible to prevent the occupant from falling sick due to a rapid temperature change as much as possible. When the sensory temperature is maintained as much constant as possible, it becomes possible to avoid a disadvantageous case in which the occupant operates a remote controller 6 to lower the set temperature beyond the necessity when the living room space becomes hot, the temperature during a time span at which no energy-saving control is performed is lowered too much, and thus the power consumption increases.

The control order can be calculated in consideration of not only a distance from the air-conditioner (indoor device) 2 that was subjected to the last energy-saving control but also distances from the control-target air-conditioner (indoor device) 2 of the time before last and the prior control-target that is even prior to the control-target of the time before last. Hence, the control order can be set in such a way that the energy-saving control is not concentrated in an arbitrary area.

The control order for the energy-saving control is calculated based on the positional coordinates (disposed location information 82) of the icon 400 of the air-conditioner (indoor device) 2 on the plan view set when the air-conditioner (indoor device) 2 is normally monitored. Hence, it is unnecessary to make a new setting for calculating the control order for the energy-saving control, and the work burden for a worker can be reduced.

When the connection information 61, area information 71, and disposed location information 82 of the air-conditioner (indoor device) 2 are changed, the control order for the energy-saving control is automatically recalculated. Hence, an appropriate control order in accordance with the current disposed condition of the air-conditioner (indoor device) 2 can be always maintained.

Second Embodiment

Next, an explanation will be given of a second embodiment of the present invention.

In the above-explained first embodiment, the unit of the control that is the energy-saving control is carried out device by device. According to this embodiment, the plurality of air-conditioners (indoor devices) 2 are taken as a group, an air-conditioning system 1 is provided which can perform the energy-saving control group by group.

In the case of an actual building, etc., in order to reduce the number of remote controllers 6, the plurality of air-conditioners (indoor devices) 2 are often taken as a unit of control (a group), and are connected to one remote controller 6. The energy-saving control group by group is suitable for such a case.

When the air-conditioners (indoor devices)2 are grouped, in order to perform the energy-saving control, such as the deactivation control or the blowing control, which are operable through the remote controller 6, it is necessary to perform the energy-saving control with the same control content on all air-conditioners (indoor devices) 2 in the group so that the operation status of the air-conditioner (indoor device) 2 displayed on the remote controller 6 becomes consistent with the actual operation status of the air-conditioner (indoor device) 2. Hence, the air-conditioning control device 4 performs the energy-saving control, such as the deactivation control or the blowing control, for each group.

Conversely, each air-conditioner (indoor device) 2 is provided with a function of autonomously adjusting the amount of a flowing coolant to control a air expelled temperature, thereby making the indoor temperature close to the set temperature. This function is a function that cannot be directly operated through the remote controller 6. In other words, this function is a function controllable for each air-conditioner (indoor device) 2 in the same group. Hence, according to this embodiment, the air-conditioning control device 4 transmits an instruction of forcibly cutting off the coolant amount, and performs the energy-saving control like a so-called thermo-off control for each device.

Moreover, the air-conditioning control device 4 groups the plurality of air-conditioners (indoor devices) 2 common to the same remote controller 6, and makes the unit of control for performing the energy-saving control changeable between the group by group mode and the device by device mode to perform the energy-saving control in the optimized unit of control in accordance with the control content.

Figure 11:
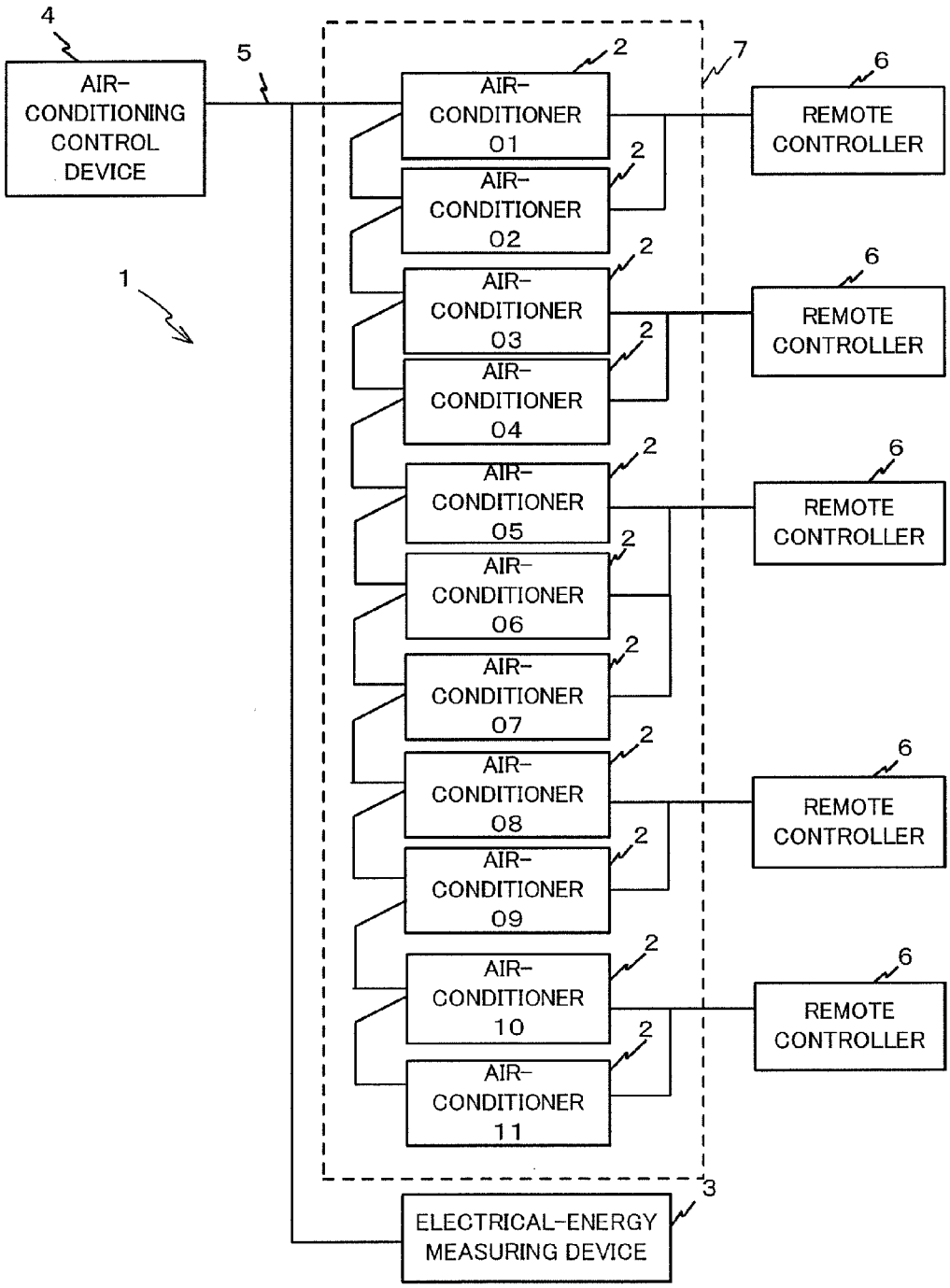
FIG. 11 is a block diagram illustrating a configuration of an air-conditioning system according to a second embodiment of the present invention.

FIG. 11 illustrates a schematic configuration of the air-conditioning system 1 according to this embodiment. As illustrated in FIG. 11, according to this air-conditioning system 1, the common remote controller 6 is connected to air-conditioners 01 and 02 among the air-conditioners (indoor devices) 2. Moreover, the common remote controller 6 is connected to air-conditioners 03 and 04 among the air-conditioners (indoor devices) 2. The common remote controller 6 is connected to air-conditioners 05, 06, and 07 among the air-conditioners (indoor devices) 2. The common remote controller 6 is connected to air-conditioners 08 and 09 among the air-conditioners (indoor devices) 2. Furthermore, the common remote controller 6 is connected to air-conditioners 10 and 11 among the air-conditioners (indoor devices) 2.

Figure 12A:
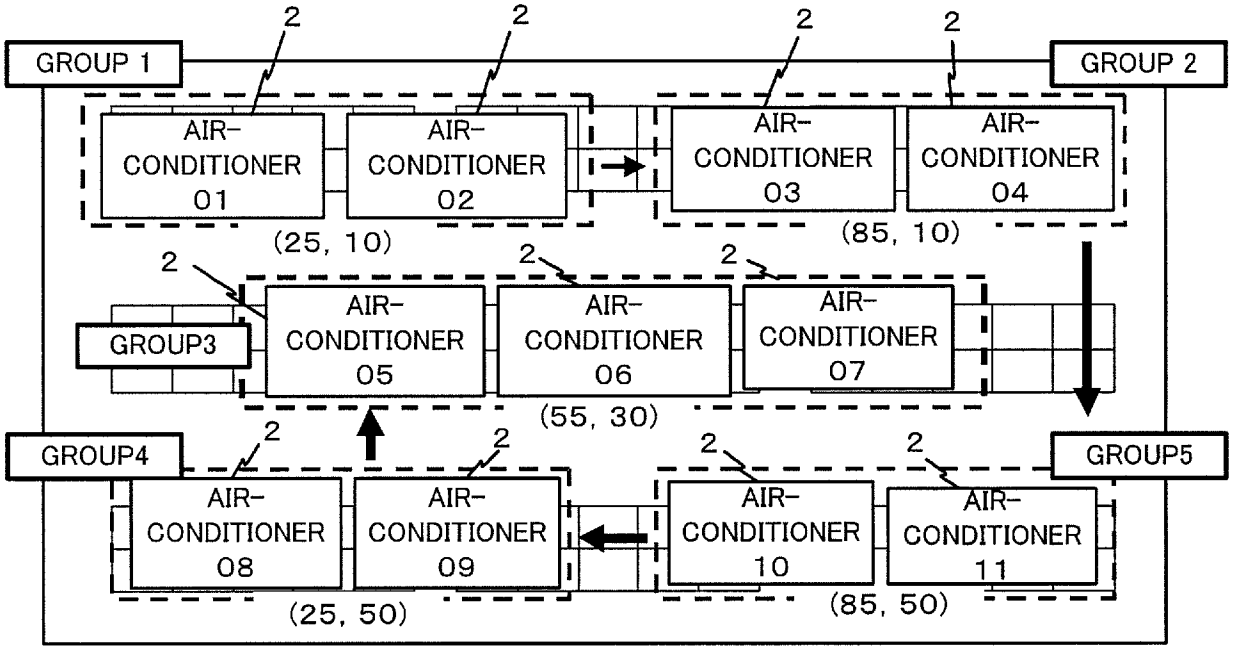
FIG. 12A is a diagram illustrating grouped air-conditioners and an example control order thereof.

FIG. 12A illustrates the air-conditioners (indoor devices) 2 partitioned group by group on a plan view. FIG. 12B illustrates a table indicating a correspondence relationship between the group and the air-conditioner (indoor device) 2. As illustrated in FIG. 12A and FIG. 12B, the air-conditioners 01 and 02 are registered in a group 1, and the air-conditioners 03 and 04 are registered in a group 2. Moreover, the air-conditioners 05, 06, and 07 are registered in a group 3, the air-conditioners 08 and 09 are registered in a group 4, and the air-conditioners 10 and 11 are registered in a group 5.

Note that the positional coordinates of each group illustrated in FIG. 12A are an average value of the positional coordinates of the air-conditioners (indoor devices) 2 included in that group.

The other configuration of this embodiment is the same as that of the first embodiment.

Next, an explanation will be given of an operation of the air-conditioning system 1 according to this embodiment.

First, an explanation will be given of an initial setting process. The flow of the initial setting process performed when the air-conditioning system 1 is activated is the same as that of the first embodiment (see FIG. 3). However, the connection information 61 of the air-conditioner (indoor device) 2 registered in step S1 also includes, for example, a table illustrated in FIG. 12B and relating to the group to which each air-conditioner (indoor device) 2 belongs.

The other detail of the initial setting process is the same as that of the first embodiment.

Next, an explanation will be given of a control-order calculating process. This control-order calculating process is performed when the air-conditioning control device 4 is activated, and when the air-conditioner connection information 61, the area information 71, and the disposed location information 82 are changed.

The flow of the control-order calculating process is the same as that of the first embodiment. In this embodiment, however, the control-order calculating process is performed with the unit of control being block by block, and the control-order calculating process is also performed with the unit of control being device by device. That is, both the block-by-block control order and the device-by-device control order are calculated. When a group-by-group control order is calculated, a group is regarded as an air-conditioner (indoor device) 2, and the control order is calculated. The positional coordinates of each group are an average of the positional coordinates of the air-conditioners (indoor devices) 2 included in the disposed location information 82.

FIG. 12A illustrates arrows that indicate the control order for the energy-saving control calculated through an execution of the control-order calculating process described in the first embodiment with each group being taken as a unit of control. When the group-by-group control order is calculated, as illustrated in FIG. 12A, the energy-saving control transitions group by group, and in the case of FIG. 12A, the energy-saving control is performed in the order of group 1, group 2, group 5, group 4, and then group 3.

Figure 13:
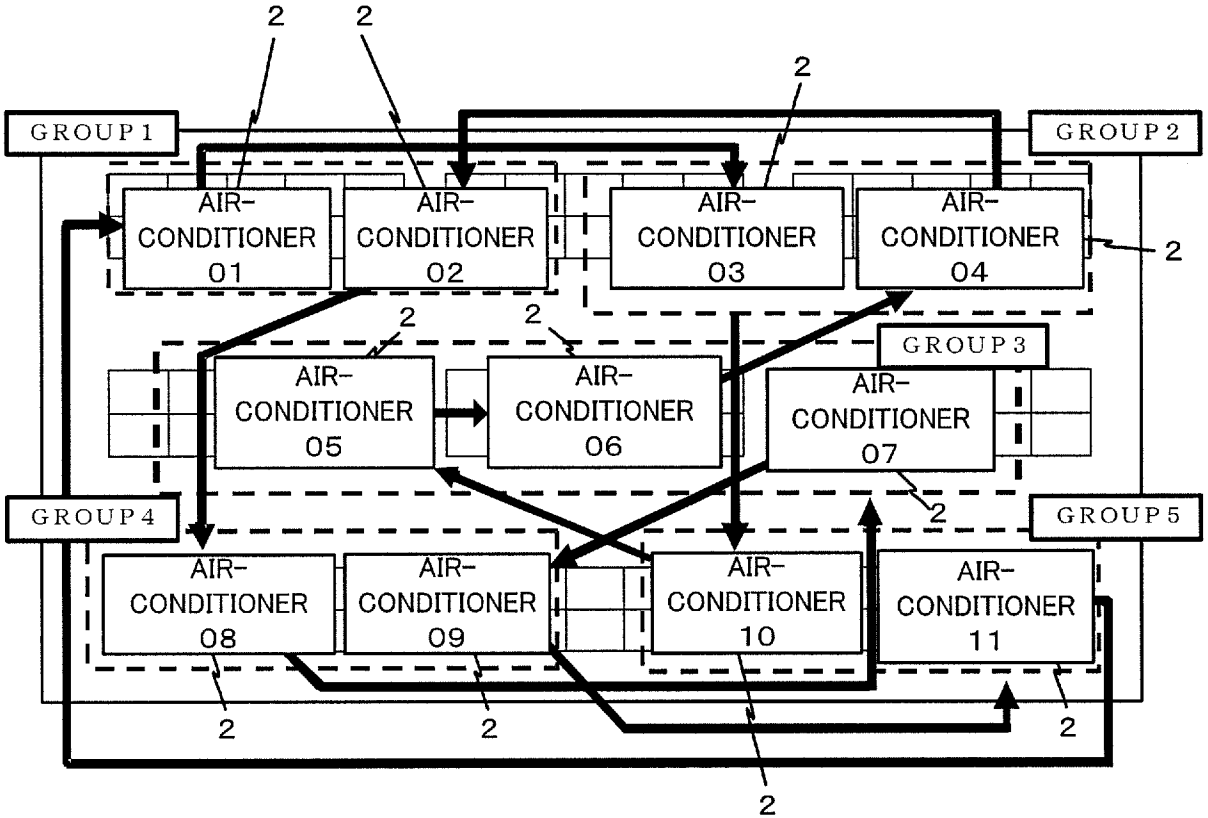
FIG. 13 is a diagram illustrating an example control order of an energy-saving control device by device.

FIG. 13 illustrates the control order for the energy-saving control calculated through an execution of the control-order calculating process described in the first embodiment with the unit of control being device by device. When the device-by-device control order is calculated, as illustrated in FIG. 13, the energy-saving control is performed in the order of air-conditioner 01, air-conditioner 03, air-conditioner 10, air-conditioner 05, air-conditioner 06, air-conditioner 04, air-conditioner 02, air-conditioner 08, air-conditioner 07, air-conditioner 09, and then air-conditioner 11 like the first embodiment regardless of the operated group.

Figure 14A:
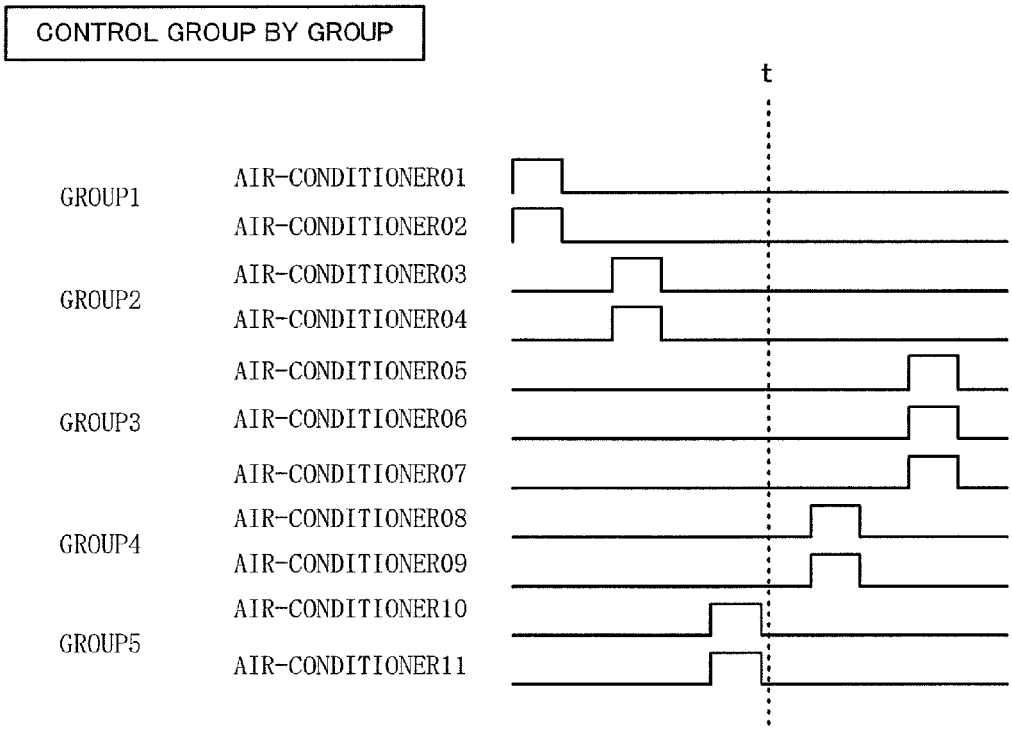
FIG. 14A is a timing chart illustrating an example on/off pattern of the energy-saving control group by group.
Figure 14B:
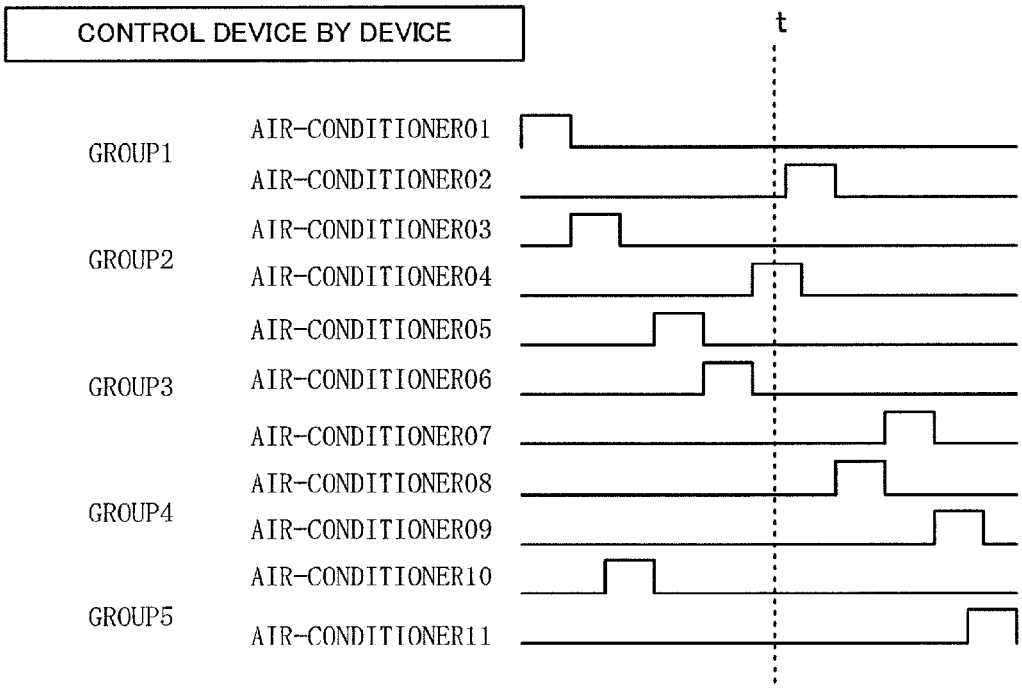
FIG. 14B is a timing chart illustrating an example on/off pattern of the energy-saving control device by device.

FIG. 14A illustrates a timing chart of the energy-saving control when the unit of control is group by group. Moreover, FIG. 14B illustrates a timing chart of an on/off pattern of the energy-saving control when the unit of control is device by device. The timing of the on/off pattern for performing the energy-saving control group by group and device by device is set based on the control time 73 and the number of control-target air-conditioners (indoor devices) 2 retained in the area information 71.

When the control content must be common to each group, such as a deactivation control or a blowing control, the controller 50 performs the energy-saving control group by group. Moreover, when the control content is autonomously controlled by the air-conditioner itself like thermo-off, the controller 50 performs the energy-saving control device by device. This makes it possible for the air-conditioning system to reduce environmental discomfort as much as possible.

For example, it is presumed that in the energy-saving setting data 42, [three minutes (during 30 minutes)] is set as the control time corresponding to the control level 3, and [deactivation] is set as the control content. Moreover, it is also presumed that [three minutes (during 30 minutes)] is set as the control time corresponding to the control level 2, and [thermo-off] is set as the control content. When the electrical energy measured by the electrical-energy measuring device 3 becomes lower than the threshold, the controller 50 determines that the electrical energy has some leeway, changes the control level from 3 to 2, and changes the control content from the deactivation control to the thermo-off control.

Figure 15:
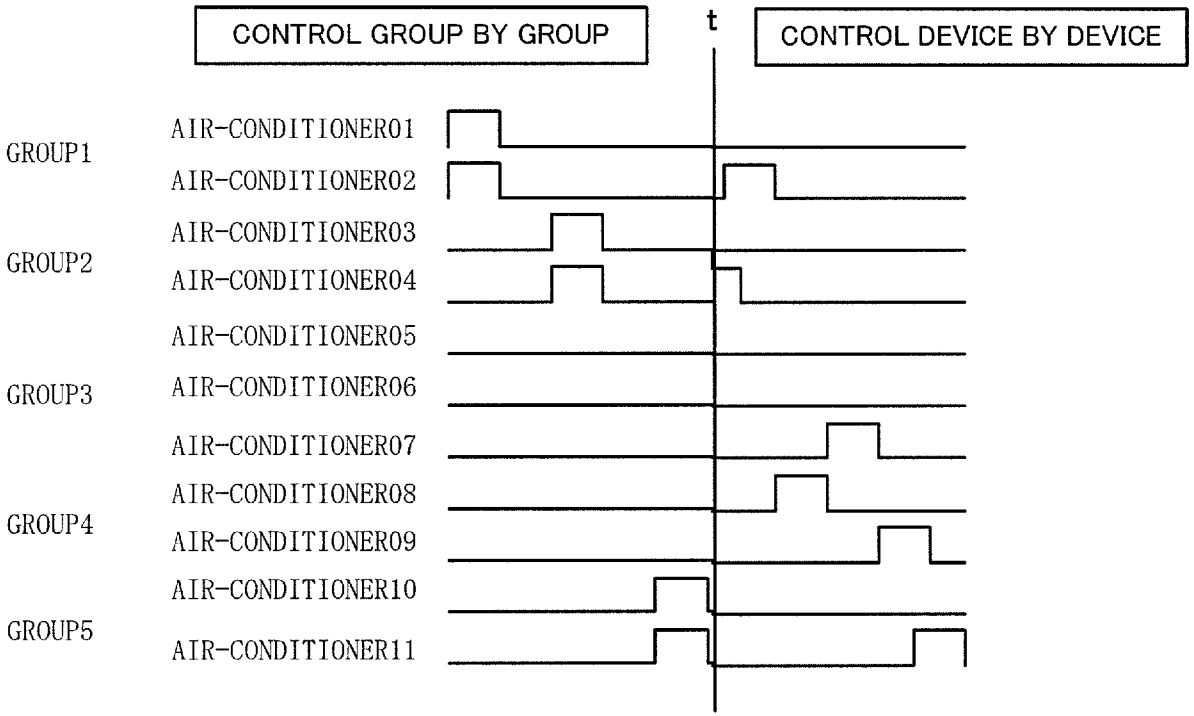
FIG. 15 is a timing chart for explaining how a control order of the energy-saving control changes.

In response to the change in the control content, the control executor 53 changes the unit of control from group by group to device by device. For example, as illustrated in FIG. 15, when the control level is 3, the control executor 53 has been performing the energy-saving control group by group, but at a time point t at which the electrical energy becomes lower than the predetermined threshold, the control executor 53 changes the control level from 3 to 2, changes the control content from the deactivation control to the thermo-off control, and changes the energy-saving control from group by group to device by device.

The on/off pattern of the energy-saving control for each group and for each device may be calculated based on the number of devices to be controlled and the control time 73, or may be created using an on/off pattern registered in advance.

The controller 50 may calculate and retain the on/off pattern when the air-conditioning control device 4 is activated and when the setting is changed, or may set the control-target air-conditioner (indoor device) 2 for each minute, and may perform the energy-saving control every time the control-target is set.

According to this embodiment, the controller 50 displays the icons 400 of the air-conditioners (indoor devices) 2 on the display device 10 in the device-by-device manner, but may display the icons of the groups. Moreover, the disposed location information 82 may include the positional coordinates of the group.

As explained above in detail, according to the air-conditioning control device 4 of this embodiment, the energy-saving control is enabled group by group.

According to the air-conditioning control device 4 of this embodiment, the energy-saving control is changed between the group-by-group manner and the device-by-device manner in accordance with the control content. More specifically, when the control content is an entry that is operable through the remote controller, the controller 50 performs the energy-saving control group by group, and when the control content is an entry that is inoperable through the remote controller, the controller performs the energy-saving control device by device. Hence, there will be no difference between the display on the remote controller 6 and the actual operation status of the air-conditioner (indoor device) 2, and the energy-saving can be accomplished while reducing environmental discomfort as much as possible.

When, for example, there are no restrictions on energy usage, the device-by-device energy-saving control in view of the environmental comfort is performed, and when a shortfall of electrical energy becomes apparent and it is desirable to reduce the electrical energy consumption in comparison with a normal case through a deactivation control, the energy-saving control is changed to the group-by-group energy-saving control. This enables the optimized energy-saving control in accordance with the usage of the electrical energy.

A program run in the above-explained embodiments can be distributed in a manner stored in a computer-readable recording medium, such as a flexible disk, a CD-ROM (Compact Disk Read-Only Memory), a DVD (Digital Versatile Disk), or an MO (Magneto-Optical Disk), and such a program is installed to configure a system executing the above-explained processes.

The program may be stored in a disk device, etc., of a predetermined server device over a communication network like the Internet, and may be, for example, downloaded in a manner superimposed on carrier waves, etc.

When, for example, the above-explained functions are carried out by an OS (Operating System) or are realized by cooperative operations of the OS and an application, only portions other than the OS may be stored in a medium and distributed, and may be, for example, downloaded.

The present invention can be carried out in various embodiments and changed and modified in various forms without departing from the broadest spirit and scope of the present invention. The above-explained embodiments are to explain the present invention, and are not to limit the scope of the present invention. That is, the scope of the present invention is indicated by the appended claims rather than the embodiments. Various modifications and changes within the scope of the appended claims and within the range of the equivalents thereto should be within the scope of the present invention.

This application is based on Japanese Patent Application No. 2010-182919 filed on Aug. 18, 2010. The entire specification, claims, and drawings of Japanese Patent Application No. 2010-182919 are herein incorporated in this specification by reference.

INDUSTRIAL APPLICABILITY

The present invention is suitable for an environmental control within a living room space where a plurality of air-conditioners (indoor devices) are disposed.

DESCRIPTION OF REFERENCE NUMERALS

1 Air-conditioning system
2 Air-conditioner (indoor device)
3 Electrical-energy measuring device
4 Air-conditioning control device
5 Dedicated communication line
6 Remote controller (remote)
7 Air-conditioner group
10 Display device
20 Input device
30 Communication manager
40 Data manager
41 Air-conditioner data
42 Energy-saving setting data
43 Disposed location data
44 Measuring-device data
50 Controller
51 Distance calculator
52 Control order setter
53 Control executer
61 Connection information
62 Operation status data
71 Area information
72 Control level
73 Control time
74 Control content
81 Plan view information
82 Disposed location information
91 Connection information
92 Measured-status data
400 Icon

The invention claimed is:

1. An air-conditioning control device that controls a plurality of air-conditioners disposed at different locations within a predetermined living room space, the air-conditioning control device comprising:

a memory that stores location information for each air-conditioner;

a distance calculator that calculates, among the plurality of air-conditioners, respective distances between an already-set air-conditioner for which a control order has already been set and remaining air-conditioners for which the control order has yet to be set, wherein the control order is for energy-saving control that controls respective air-conditioners for a predetermined time to reduce power consumption and wherein the respective distances are calculated based on the location information stored in the memory;

a control order setter that sets, based on the distances calculated by the distance calculator, the control order for each air-conditioner in such a way that time spans for performing the energy-saving control in respective sections of the living room space are balanced; and a control executer that repeatedly executes the energy-saving control on each air-conditioner in accordance with the control order set by the control order setter, wherein the control order setter repeats a process of obtaining a proximity order of the remaining air-conditioners relative to the already-set air-conditioner based on the calculated distances, and selecting, as a next control-target, the air-conditioner with the proximity order corresponding to a predetermined proportion of a number of the remaining air-conditioners until all air-conditioners have been selected as control-targets.

2. The air-conditioning control device according to claim 1, wherein the control order setter calculates the proximity order based on a distance from a last control-target air-conditioner among the already-set air-conditioners.

3. The air-conditioning control device according to claim 2, wherein the control order setter calculates, for the air-conditioners with a same distance from the last control-target air-conditioner, the proximity order in an order of a closer distance to the air-conditioner that is a previous control-target to the last control-target.

4. The air-conditioning control device according to claim 1, wherein the plurality of air-conditioners are put together in several groups with common operation input means, the distance calculator calculates a distance between respective groups based on location information of each group when a control content of the energy-saving control is operable through the operation input means, the control order setter sets, based on the distance between respective groups, a control order for performing the energy-saving control on respective groups in such a way that time spans for performing the energy-saving control in respective sections of the living room space are balanced, and the control executer repeatedly executes the energy-saving control on each group in accordance with the set control order.

5. The air-conditioning control device according to claim 4, wherein the control executer executes the energy-saving control group by group for the control content of the energy-saving control that is operable through the operation input means, and executes the energy-saving control device by device for the control content of the energy-saving control that is inoperable through the operation input means.

6. The air-conditioning control device according to claim 5, wherein when an electrical energy of the plurality of air-conditioners exceeds a predetermined threshold, the control content of the energy-saving control is set to be a control content operable through the operation input means, and when the electrical energy of the plurality of air-conditioners becomes lower than the predetermined threshold, the control content of the energy-saving control is set to be a control content inoperable through the operation input means.

7. The air-conditioning control device according to claim 1, further comprising:

a display which displays a plan view of a floor of the living room space and which also displays an icon indicating an operation status of each air conditioner at a location in the plan view corresponding to a location in the living room space where each air-conditioner is disposed; and an inputter that is capable of adjusting a position of the icon displayed on the display through an operation input, wherein the memory stores position information of the icon of each air-conditioner, and the distance calculator calculates the distances based on the position information of the icon of each air-conditioner.

8. The air-conditioning control device according to claim 1, wherein every time information stored in the memory is updated, the distance calculator calculates the distances based on information on the location stored in the memory, and the control order setter sets the control order for each air-conditioner.

9. An air-conditioning control method that controls a plurality of air-conditioners disposed at different locations within a predetermined living room space, the air-conditioning control method comprising:

a distance calculating step for calculating, among the plurality of air-conditioners, respective distances between an already-set air-conditioner for which a control order has already been set and remaining air-conditioners for which the control order has yet to be set, wherein the control order is for energy-saving control that controls respective air-conditioners for a predetermined time to reduce power consumption, and wherein the respective distances are calculated based on information on a location for each air-conditioner stored in a memory;

a control order setting step for setting, based on the distances calculated in the distance calculating step, the control order for each air-conditioner in such a way that time spans for performing the energy-saving control in respective sections of the living room space are balanced; and a control executing step for repeatedly executing the energy-saving control on each air-conditioner in accordance with the control order set through the control order setting step, wherein the control order setting step comprises repeating a process of obtaining a proximity order of the remaining air-conditioners relative to the already-set air-conditioner based on the calculated distances, and selecting, as a next control-target, the air-conditioner with the proximity order corresponding to a predetermined proportion of a number of the remaining air-conditioners until all air-conditioners have been selected as control-targets.

10. A non-transitory computer readable recording medium on which is recorded a program that allows a computer which controls a plurality of air-conditioners disposed at different locations in a predetermined living room space to function as:

a distance calculating unit for calculating, among the plurality of air-conditioners, respective distances between an already-set air-conditioner for which a control order has already been set and remaining air-conditioners for which the control order has yet to be set, wherein the control order is for energy-saving control that controls respective air-conditioners for a predetermined time to reduce power consumption, and wherein the respective distances are calculated based on information on a location for each air-conditioner stored in a memory;

a control order setting unit for setting, based on the distance calculated by the distance calculating unit, the control order for each air-conditioner in such a way that time spans for performing the energy-saving control in respective sections of the living room space are balanced; and a control executing unit for repeatedly executing the energy-saving control on each air-conditioner in accordance with the control order set by the control order setting unit, wherein the control order setting unit repeats a process of obtaining a proximity order of the remaining air-conditioners relative to the already-set air-conditioner based on the calculated distances, and selecting, as a next control-target, the air-conditioner with the proximity order corresponding to a predetermined proportion of a number of the remaining air-conditioners until all air-conditioners have been selected as control-targets.

11. The air-conditioning control method according to claim 9, wherein the control order setting step calculates the proximity order based on a distance from a last control-target air-conditioner among the already-set air-conditioners.

12. The air-conditioning control method according to claim 11, wherein the control order setting steps calculates, for the air-conditioners with a same distance from the last control-target air-conditioner, the proximity order in an order of a closer distance to the air-conditioner that is a previous control-target to the last control-target.

13. The air-conditioning control method according to claim 9, wherein the plurality of air-conditioners are put together in several groups with common operation input means, the distance calculating step calculates a distance between respective groups based on location information of each group when a control content of the energy-saving control is operable through the operation input means, the control order setting step sets, based on the distance between respective groups, a control order for performing the energy-saving control on respective groups in such a way that time spans for performing the energy-saving control in respective sections of the living room space are balanced, the control executing step repeatedly executes the energy-saving control on each group in accordance with the set control order, wherein the control executing step executes the energy-saving control group by group for the control content of the energy-saving control that is operable through the operation input means, and executes the energy-saving control device by device for the control content of the energy-saving control that is inoperable through the operation input means, when an electrical energy of the plurality of air-conditioners exceeds a predetermined threshold, the control content of the energy-saving control is set to be a control content operable through the operation input means, and when the electrical energy of the plurality of air-conditioners becomes lower than the predetermined threshold, the control content of the energy-saving control is set to be a control content inoperable through the operation input means.

14. The non-transitory computer readable recording medium according to claim 10, wherein the control order setting unit calculates the proximity order based on a distance from a last control-target air-conditioner among the already-set air-conditioners.

15. The non-transitory computer readable recording medium according to claim 14, wherein the control order setting unit calculates, for the air-conditioners with a same distance from the last control-target air-conditioner, the proximity order in an order of a closer distance to the air-conditioner that is a previous control-target to the last control-target.

16. The non-transitory computer readable recording medium according to claim 10, wherein the plurality of air-conditioners are put together in several groups with common operation input means, the distance calculating unit calculates a distance between respective groups based on location information of each group when a control content of the energy-saving control is operable through the operation input means, the control order setting unit sets, based on the distance between respective groups, a control order for performing the energy-saving control on respective groups in such a way that time spans for performing the energy-saving control in respective sections of the living room space are balanced, the control executing unit repeatedly executes the energy-saving control on each group in accordance with the set control order, wherein the control executing unit executes the energy-saving control group by group for the control content of the energy-saving control that is operable through the operation input means, and executes the energy-saving control device by device for the control content of the energy-saving control that is inoperable through the operation input means, when an electrical energy of the plurality of air-conditioners exceeds a predetermined threshold, the control content of the energy-saving control is set to be a control content operable through the operation input means, and when the electrical energy of the plurality of air-conditioners becomes lower than the predetermined threshold, the control content of the energy-saving control is set to be a control content inoperable through the operation input means.

* * * * *